US005725122A

United States Patent [19]

Murphy et al.

[11] Patent Number: 5,725,122

[45] Date of Patent: Mar. 10, 1998

[54] STORAGE LIDS FOR CONTAINERS

[75] Inventors: Joseph B. Murphy, Worcester; Henry J. Blanchette, Leominster, both of Mass.; Richard P. Smagala, Glens Falls, N.Y.

[73] Assignee: Plastican, Inc., Leominster, Mass.

[21] Appl. No.: 604,454

[22] Filed: Feb. 21, 1996

Related U.S. Application Data

[62] Division of Ser. No. 480,959, Jun. 7, 1995, abandoned, which is a continuation of Ser. No. 13,069, Feb. 3, 1993, abandoned.

[51] Int. Cl.[6] ..... B65D 53/00

[52] U.S. Cl. ..... 220/521; 220/212; 220/501; 220/524; 220/254; 220/285; 220/782; 220/784; 220/793; 220/795; 206/508

[58] Field of Search ..... 220/212, 501, 220/502, 521, 524, 527, 254, 284, 285, 286, 782, 784, 790, 791, 793, 795, 601; 206/508

[56] References Cited

U.S. PATENT DOCUMENTS

| | | | |
|---|---|---|---|
| 1,600,758 | 9/1926 | Goldstein | 220/521 |
| 1,616,665 | 2/1927 | Murch | 220/521 X |
| 2,015,028 | 9/1935 | Gillette | 220/521 X |
| 3,045,859 | 7/1962 | McMahon | 220/521 |
| 3,618,802 | 11/1971 | Yates, Jr. | 220/795 X |
| 3,811,597 | 5/1974 | Frankenberg et al. | 220/284 |
| 4,151,910 | 5/1979 | Yasur | 206/216 |
| 4,203,517 | 5/1980 | Hildebrandt et al. | 220/521 X |
| 4,574,974 | 3/1986 | Von Holdt | 220/780 |
| 4,747,500 | 5/1988 | Gach et al. | 220/377 X |
| 4,779,754 | 10/1988 | Ten Eyck et al. | 220/254 |
| 4,836,370 | 6/1989 | Bosshard | 206/222 |
| 5,169,021 | 12/1992 | Schutz | 220/521 |

FOREIGN PATENT DOCUMENTS

| | | | |
|---|---|---|---|
| 717858 | 10/1966 | Italy | 220/521 |
| 271265 | 5/1927 | United Kingdom | 220/521 |

*Primary Examiner*—Stephen Cronin
*Attorney, Agent, or Firm*—Pandiscio & Pandiscio

[57] ABSTRACT

A lid assembly is provided for a pail which is characterized by a receptacle portion that is closed of by a secondary lid. The receptacle portion is provided for storing and displaying items related to the contents of the pail, e.g., small tools or instructions. The lid assembly may also have a pouring spout, either within or outside of the receptacle portion, so that the contents of the pail may be emptied without removing the entire lid assembly.

21 Claims, 3 Drawing Sheets

STORAGE LIDS FOR CONTAINERS

This is division of U.S. application Ser. No. 08/480,959, filed 7 Jun. 1995 now abandoned which is a continuation of U.S. application Ser. No. 08/013,069, filed 3 Feb. 1993 for Storage Lids For Containers, now abandoned.

This invention relates to containers with removable lids or covers, and more particularly to containers having a lid or cover which functions as an additional container.

BACKGROUND OF THE INVENTION

Plastic containers in various sizes are widely manufactured and used. Existing conventional designs of plastic containers of the type used for paint, driveway coating, and other liquids or powders, typically have a closure in the form of a lid or cover that is attached to the container by a snap-fit or by a screw connection. Typically, the top of the lid or cover is contoured so that it will form a seat for the bottom of another like container, thereby allowing the containers to be stacked one upon the other.

It is desirable for marketing purposes to provide a receptacle for related products that a consumer would purchase contemporaneously, and would be required to carry separately either in a bag or other package. Thus, for example, in purchasing a container full of paint, the consumer might also wish to purchase a trim pad, brushes, scrapers, masking tape, drop cloths, etc. In the case of containers full of detergent, sponges and chamois may be saleable with the detergent. Where a container is filled with wallpaper paste, accessory items a customer may wish to simultaneously purchase are brushes, cutters, edge rollers, and an applicator brush. In the case of buckets containing fishing bait, a receptacle for lures and tackle is also desirable. Where a pail is filled with joint compound, additional items which might accompany it are seam tape, a sponge, gloves, and putty knives. In all events it may be desirable to provide printed instructions to guide the user.

In U.S. Pat. No. 4,836,370, issued on Jun. 6, 1989 to Alexander Bosshard, it has been suggested that a container be divided into two receiving chambers by some type of partition wall, such as may be accomplished by nesting one container within another, the purpose being to provide an opening in the partition wall between the two containers when one container is manipulated, so as to permit the intermixing of the respective materials placed in each container.

However, there has been no suggestion for providing an additional receptacle as part of a closure or lid for a pail for holding accessory articles which are not to be intermixed with the contents of the pail, and which lid may be applied to and removed from the pail without affecting its contents.

SUMMARY OF THE INVENTION

It is therefore one object of the invention to provide plastic containers for selected goods that are characterized by having an additional receptacle for related products that would be sold contemporaneously.

A further object of the invention is to provide a plastic container having a lid which is characterized by having a receptacle for products related to the product stored in the container.

Still another object of the invention is to provide a plastic container having a removable cover or lid, characterized by also having a receptacle for related products that is removable with the cover or lid.

Still another object of the invention is to provide a container within a container, with one of the containers forming part of the cover for the other container.

These and other objects are achieved by providing a removable cover or closure for a plastic pail which is molded so as to provide a receptacle for related products. The closure is also provided with a removable lid for closing off the receptacle, with the lid optionally being transparent so as to permit inspection of the products contained in the auxiliary receptacle without removal of the lid.

Other features and advantages of the invention are set forth in or rendered obvious by the following detailed description of the invention which is to be considered together with the drawings hereinafter described.

DETAILED DESCRIPTION OF THE INVENTION

Figure 1:
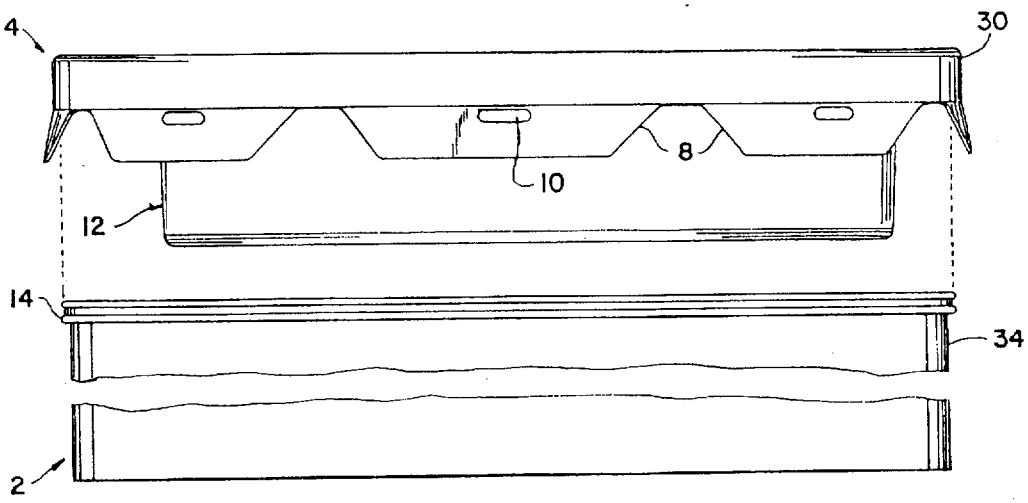
FIG. 1 is a fragmentary exploded view in side elevation showing a container comprising a pail and a lid assembly constituting a preferred embodiment of the invention.

FIG. 1 shows a circular pail 2 and a circular lid 4 assembly 4 that constitutes a preferred embodiment of the invention. As seen best in FIGS. 3 and 4, the lid assembly comprises a primary lid that includes an upper crown 6 and an outer rim 30 on its outer periphery. The rim 30 is rigidized by a series of radially-extending mutually-spaced strengthening ribs 26 (FIG. 3) formed on the inside surface 28 of rim 30, and extending and integral with the annular top surface 32 of the crown 6. When successive containers are stacked one on top of another the bottom of one pail rests on this annular surface 32.

In this preferred form of the invention, rim 30 has a series of circumferentially-spaced, preferably like size, depending flaps 8 formed on its outer periphery, all of which are shown as being provided with circumferentially-elongated openings 10. Crown 6 comprises a depending receptacle portion 12 formed integral with it. Receptacle portion 12 is circular and is coaxial with crown 6 and rim 30.

Figure 2:
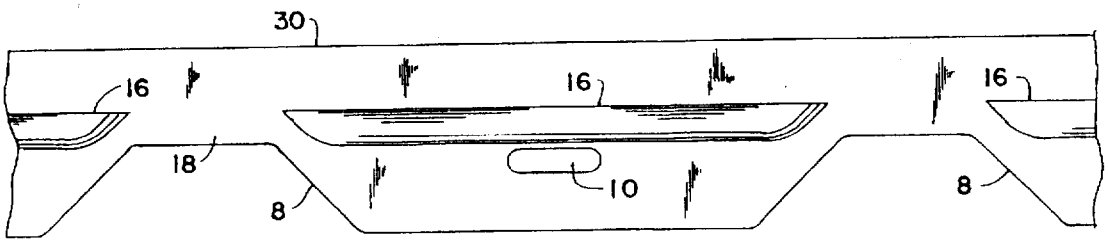
FIG. 2 is an enlarged fragmentary view in side elevation of the inside surface of the rear portion of the lid assembly.

The pail 2 is provided with an annular lip or locking flange 14 formed integral with and protruding outwardly from the upper end edge portion of its side wall 34 to permit secure assembly and retention of the lid assembly 4 on the pail. As shown in FIG. 2, each flap 8 is provided with an internally projecting rib element 16 on its inside surface 18, which is rounded and sized so that it may be snapped over and interlocked with flange 14 of wall 34.

Figure 4:
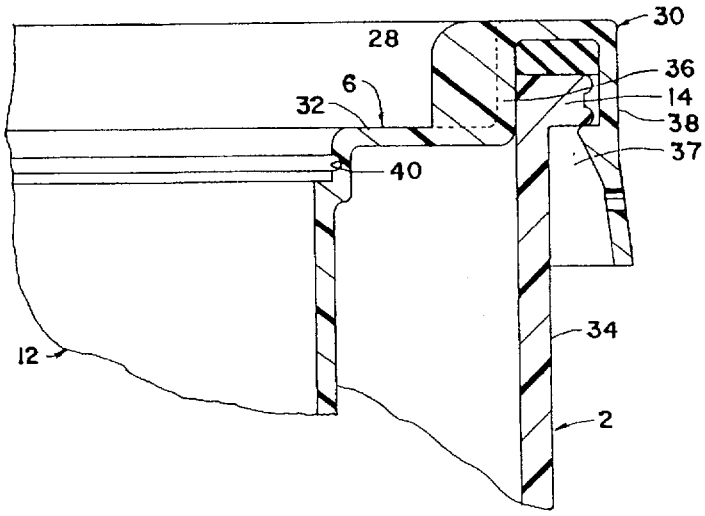
FIG. 4 is a fragmentary cross-sectional view on an enlarged scale of a portion of the primary lid and the top of the pail.

This lid/pail snap locking arrangement is illustrated in FIG. 4, wherein rim 30 is shown as having an inner wall portion 36 and an outer wall portion 38 which are spaced from one another to form a channel 37 for reception of the upper portion of wall 34 of the pail.

When it is desired to remove the lid from the pail the flaps 8 need only be pulled outwardly and upwardly far enough so that the ribs 16 are released from their position beneath the flange 14. This action may be aided by placing a tool such as a screwdriver into one of the slots 10 and then using the screwdriver to bend the flap away from the pail as described above.

Figure 3:
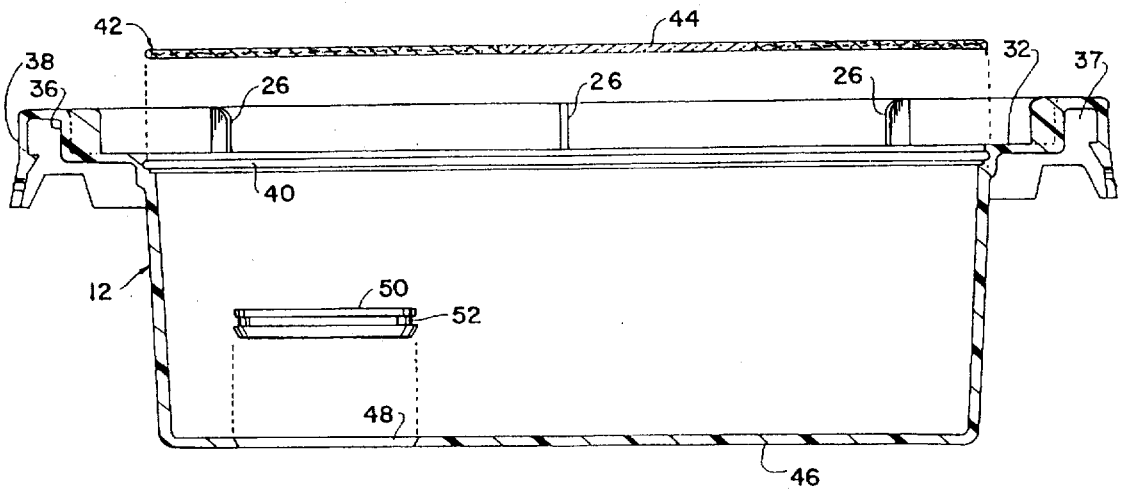
FIG. 3 is a cross-sectional view taken through the lid assembly of FIG. 1, slightly modified to show a pouring spout, with the secondary or auxiliary lid in exploded relation to the primary lid.

The receptacle portion 12 is provided with an internal circumferentially-extending groove 40 at its upper end (FIG. 4) to receive a second (auxiliary) lid 42 (FIG. 3). The latter lid is sized to make a snap fit in groove 40. If desired, lid 42 may be sealed in place by means of ultrasonic welding or an adhesive bond, so as to secure whatever contents may be placed within receptacle portion 12.

This second lid 42 may be made of paper, plastic or metal, and may be opaque, translucent or transparent. Preferably, as shown in FIG. 3 the second lid 40 may be fully opaque or transparent or translucent; alternatively it may be opaque but have a transparent window area 44 for displaying the contents of receptacle 12 when the lid 4 is attached to the pail 2. Preferably the lid is flexible so as to facilitate its removal by application of a prying tool, e.g., a flat blade screwdriver, or a knife, between it and groove 40.

When a user has emptied the receptacle 12 of its contents, it may be desirable to allow the contents of the pail to be dispensed without necessarily removing the lid 4 from pail 2. This can be accomplished by providing the lower wall 46 of the receptacle 12 with an opening 48 which can serve as a pouring spout. This opening 48 may be normally closed by means of a plug 50 made of a resilient material. Plug 50 has a groove 52 on its outer periphery sized to make a snap fit with the edge portion of lower wall 46 that defines opening 48.

Figure 5:
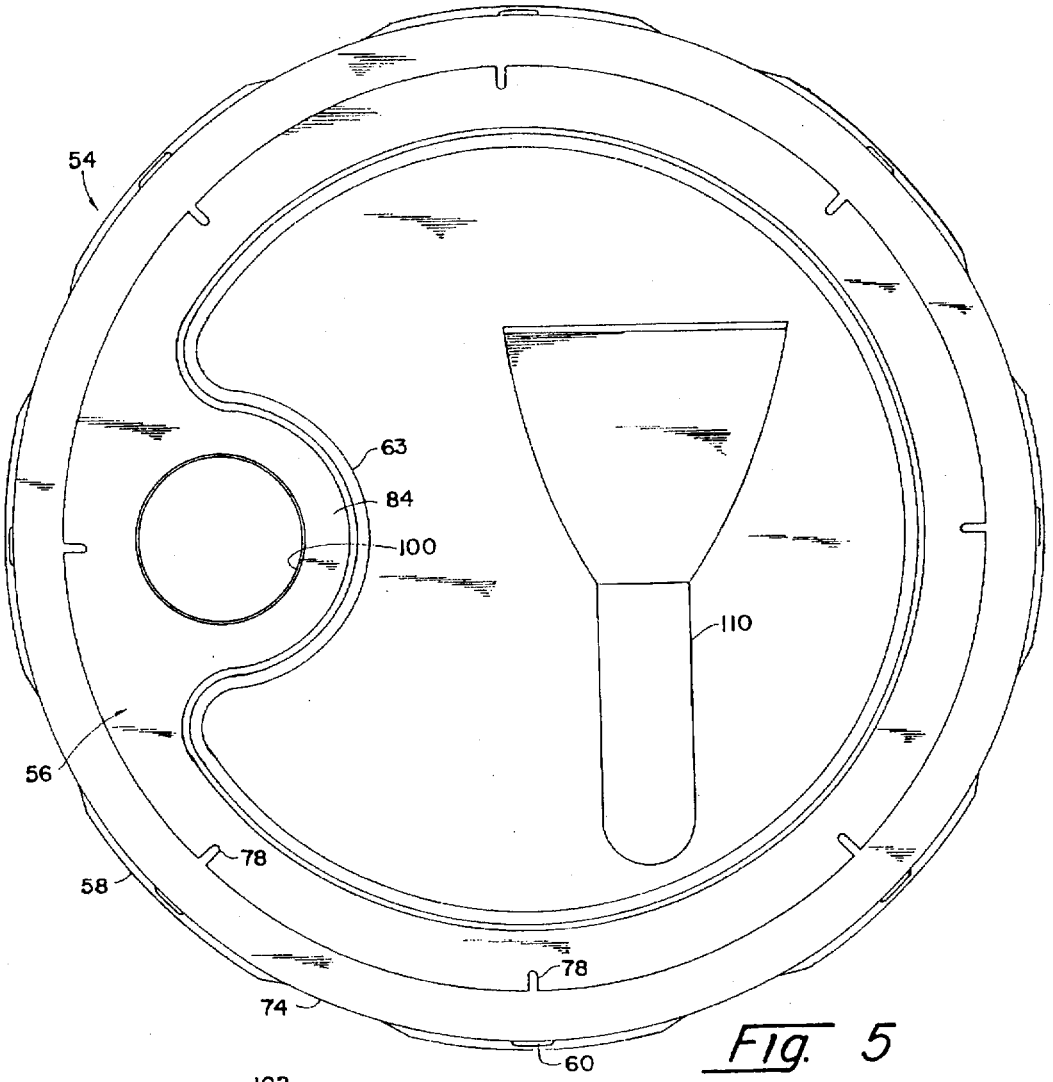
FIG. 5 is a top plan view of another form of lid assembly embodying the invention.
Figure 6:
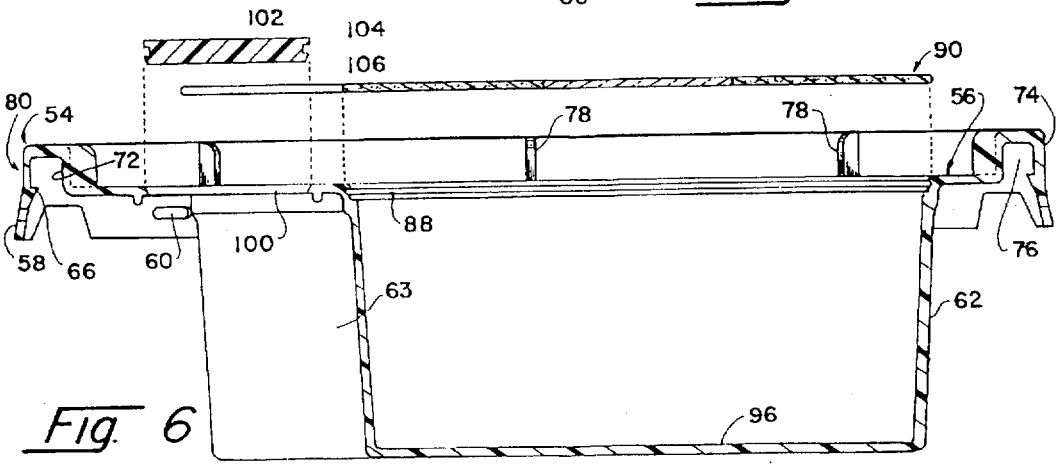
FIG. 6 is a view like FIG. 3 of the lid assembly of FIG. 5.

An alternate form of primary lid assembly is shown in FIGS. 5 and 6. This alternative form of lid assembly is configured so as to be readily assembled and sealed to a pail, with the arrangement for securing the lid to the pail being similar to that shown in the embodiment of FIGS. 1–4. In this embodiment the lid assembly consists of a primary lid 54 and an auxilary or a secondary lid 90.

The primary lid 54 consists of a crown 56 which comprises depending receptacle portion 62, and outer rim 80. The latter has an inner wall 72 and an outer wall 74 which are spaced from one another to form a channel 76 for receiving the upper portion of pail 2. The bottom end of side wall portion 74 is scalloped so as to form a plurality of flaps 58 like flaps 8 of FIG. 2. Flaps 8 have elongate holes 60 like holes 10 of FIG. 2. Additionally, in order to effect a sealing arrangement with locking flange 14 formed integrally with and projecting outwardly from the top portion of the pail, internally projecting circumferentially-spaced locking ribs 66, like ribs 16 are formed on the inner surface of sidewall 74 above the openings 60. Openings 60 are sized to accommodate a screwdriver or other tool for use in bending flaps 58 away from the pail far enough to unlock ribs 66 from locking flange 14.

Preferably the embodiment of FIGS. 5 and 6 has a series of radially extending reinforcing ribs 78, like ribs 26 of FIGS. 1–4, that serve to rigidize rim 80.

In the embodiment of FIGS. 5 and 6 the crown 56 is extended radially inward in the area 84 in order to accommodate a pouring spout. This involves indenting the side wall of receptacle portion 62 as shown at 63. The pouring spout is formed as an opening or hole 100 in crown portion 84 (FIG. 6). This hole accommodates a plug 102 preferably made of a resilient material. The plug 102 is provided with an annular peripheral groove 104 sized to provide a snap fit with the edge portion of the opening 100 in the crown portion 84 when the plug is placed in the hole.

Assuming that plug 102 is removed from hole 102, the indentation 63 in the sidewall of receptacle portion 62 provides a pathway for the contents of the pail to exit through the opening 100 when the pail is suitably tilted, regardless of whether or not the secondary lid 90 is assembled in place.

The upper portion of receptacle 62, at its point of joinder with the crown portion 56 is provided with an internal peripheral groove 88 which is used to allow an auxilary-lid 90 to be attached with a snap fit. Groove 88 follows and conforms to the contour of the inner edge of the upper surface 82 of the crown.

The second lid 90 is preferably made of a plastic material and may be fully opaque or transparent or translucent, or may comprise opaque areas 92 and a transparent area 94 for viewing of the contents of the receptacle 62. Like groove 88, the peripheral portion of lid 90 is contoured as shown at 106, so as to conform to the shape of the inside edge of the indented portion 84 of crown 56. Auxiliary lid 90 may be assembled to the lid 54 by a simple tight fit, or it may be sealed in place by means of sonic welding or an adhesive. The receptacle may contain an implement such as the scraper 102 or any other small tool or instructions, which rest on the bottom surface 96.

It is thus seen that a container/lid assembly is provided which offers the advantage of providing an additional receptacle in the lid for storing objects related to the contents of the pail. A second advantage is that the invention is not limited to snap-on lids but may be embodied in screw-on lids, as, for example, lids as shown in U.S. Pat. Nos. 4,014,452 and 4,298,132. The invention also may be embodied in lids having a tear-strip design such as a lid having a scalloped tear strip as shown in U.S. Pat. No. 4,930,656, or a lid having a skirt with a straight tear strip, such as shown in U.S. Pat. Nos. 4,669,630, 4,819,825 and 4,865,216.

Another advantage is that the depth of the receptacle may be varied. These and other modifications may be made without departing from the spirit and scope of the invention.

What is claimed is:

1. A removable molded plastic lid for closing off the open end of a plastic pail, said lid comprising, in combination:

a circular rim having means for releasably locking said lid to the open end of a pail;

a circular crown formed integral with and extending inwardly from said rim, at least a portion of said crown being located below said rim so as to define a well into which the bottom end of a second pail may be placed for stacking purposes, said crown having an opening; and a receptacle formed integral with and depending from said crown at said opening, said receptacle having an open top end that is substantially flush with said crown and a closed bottom end, said receptacle being sized and shaped so as to extend downwardly into a pail when said lid is locked to said pail in closing off relation with the open end of the pail.

2. A lid according to claim 1 including an auxiliary lid removably attached to said first-mentioned lid adjacent said crown in position so as to close off the open top end of said receptacle.

3. A lid according to claim 1 further including an opening located so as to permit the contents of a pail to which said lid is mounted to be poured out of the pail without removing the lid from the pail.

4. A lid according to claim 3 wherein said opening is formed in said crown to the side of said receptacle.

5. A removable plastic lid assembly for a plastic pail comprising a primary lid and a secondary lid;

said primary lid being a molded plastic product comprising a crown portion defining an opening, an annular rim portion formed integral with and surrounding said crown portion, said rim portion having means for releasably locking said primary lid to a pail, and a receptacle portion formed integral with and depending from said crown portion inwardly from said rim portion, said receptacle portion having an open upper end aligned with and formed integral with said crown at said opening, said receptacle portion comprising a tubular side wall that is integral with and extends below said crown portion and a bottom wall closing off the bottom end of said tubular side wall, and substantially all of said receptacle portion being located below said crown portion, whereby when said lid assembly is attached to the open upper end of a pail, said receptacle portion will extend down into the interior space of the pail; and said secondary lid being removably disposed in said opening and being sized so as to close off the upper end of said receptacle.

6. A removable lid assembly according to claim 5 further including a second opening in said crown portion located to the side of said receptacle portion for providing access to the contents of a pail to which said primary lid is attached without need for detaching said lid assembly from said pail.

7. A lid according to claim 5 in combination with a plastic pail having an open upper end, said lid being attached to said pail by a snap-fit connection between said rim portion and said upper end of said pail.

8. In combination with a pail having a top end with an opening at said top end for introducing material to and removing material from said pail, a lid assembly removably attached to said top end of said pail so as to close off said opening;

said lid assembly including a primary lid and a secondary lid;

said primary lid being molded of a plastic material and comprising a crown portion, a circular rim portion formed integral with and surrounding said crown portion, said rim portion having lid-locking means for releasably locking said primary lid to said top end of said pail, and a receptacle portion formed integral with and depending from said crown portion, substantially all of said receptacle portion being located below said crown portion, said receptacle portion having an open upper end and being sized so that it extends down into the interior of said pail; and said secondary lid being disposed so as to close off the upper end of said receptacle portion.

9. A lid-pail combination according to claim 8 wherein said lid assembly has an opening communicating with the interior of said pail, said opening being located so that the contents of said pail may be poured out of said pail without first removing said primary lid from said pail.

10. A lid-pail combination according to claim 8 wherein said crown portion has an opening located to the side of said receptacle portion for communicating with the interior of said pail, and further including removable closure means for closing off said opening, said opening being located so that on removal of said closure means the contents of said pail may be removed without removing said primary lid from said pail.

11. A lid-pail combination according to claim 8 wherein said lid-locking means is in the form of a plurality of ribs on said rim adapted to make a snap fit with complementary elements on said pail.

12. A lid-pail combination according to claim 8 wherein at least part of said secondary lid is transparent.

13. A removable one-piece lid for a circular plastic container, said lid being molded of a thermoplastic polymer and comprising:

a crown having a top surface, a bottom surface, and an opening therethrough;

a circular rim surrounding said crown at said outer edge, said rim having an inner wall section that is formed integral with and supports said crown and an outer wall section that surrounds said inner wall section, said outer wall section being spaced from said inner wall section so as to define a channel therebetween for receiving the upper end of a plastic container, said outer wall section having an inner surface with means for interlocking with the upper end of a plastic container disposed in said channel, and said inner wall section projecting above the level of said top surface of said crown and said outer wall section extending below the level of said bottom surface of said crown; and a receptacle formed integral with and depending from said crown at said opening, said receptacle having an open upper end surrounded by said crown; and means for locking an auxiliary lid in closing relation with said upper end of said receptacle.

14. A lid according to claim 13 wherein said means for interlocking on said inner surface of said outer wall section comprises a plurality of ribs for making a snap connection with a mating flange on the upper end of a container.

15. A lid according to claim 13 wherein said crown has another opening therethrough located eccentric to said receptacle through which material can be removed from a container to which said lid is attached without having to remove said lid from said container, and further including a removable closure for said opening.

16. A plastic container with a circular cross-sectional configuration and a removable molded plastic lid for said container;

said lid comprising a crown having an opening therethrough, a circular rim formed integral with and surrounding said crown, and a receptacle formed integral with and depending from said crown;

said crown having a top surface and a bottom surface;

said having an inner wall section that is formed integral with and supports said crown and an outer wall section that surrounds said inner wall section, said outer wall section being spaced from said inner wall section so as to define a channel therebetween for receiving the upper end of said container, said outer wall section having an inner surface with first locking means for locking said lid to said container, and said inner wall section projecting above the level of said top surface of said crown and said outer wall section extending below the level of said bottom surface of said crown; and said receptacle having a tubular side wail formed integral with said crown, a bottom wall, and an open upper end, with said open upper end surrounded by said crown and aligned with said opening, said receptacle also having means for retaining an auxiliary lid in closing relation with said open upper end of said receptacle;

said container comprising a side wall terminating in an open top end that extends into said channel, said side wall having an exterior surface and second locking means on said exterior surface at said open top end for making a locking connection with said first locking means so as to secure said lid to the top end of said side wall; and said receptacle extending down into the interior of said container.

17. A container and lid combination according to claim 16 wherein said first locking means on said inner surface of said outer wall section comprises a plurality of ribs, and said second locking means is a mating flange on the upper end of said container.

18. A container and lid combination according to claim 17 wherein said crown has an opening eccentric to said receptacle through which material can be removed from said container without having to remove said lid from said container, and further including a removable closure for said opening.

19. In combination with a pail having a top end with an opening at said top end for introducing material to and removing material from said pail, a lid assembly removably attached to said top end of said pail so as to close off said opening;

said lid assembly including a primary lid and a secondary lid;

said primary lid being molded of a plastic material and comprising a crown portion, a rim portion formed integral with and surrounding said crown portion, said rim portion having lid-locking means for releasably locking said primary lid to said top end of said pail, and a receptacle portion formed integral with and depending from said crown portion, said receptacle portion having an open upper end and being sized so that it extends down into the interior of said pail; and said secondary lid being disposed so make a snap fit with a groove in the upper end of said receptacle portion and so as to close off the upper end of said receptacle portion.

20. In combination with a pail having a top end with an opening at said top end for introducing material to and removing material from said pail, a lid assembly removably attached to said top end of said pail so as to close off said opening;

said lid assembly including a primary lid and a secondary lid;

said primary lid being molded of a plastic material and comprising an annular crown portion, an annular rim portion formed integral with and surrounding said crown portion, said rim portion having lid-locking means for releasably locking said primary lid to said top end of said pail, and a receptacle portion formed integral with and depending from said crown portion, and said secondary lid being disposed so as to close off the upper end of said receptacle portion;

said crown portion having an opening located outside of said receptacle portion that communicates with the interior of said pail, whereby the contents of said pail may be removed via said opening without removing said primary or secondary lids from said pail.

21. Apparatus according to claim 20 further including removable closure means for closing off said opening.

* * * * *

UNITED STATES PATENT AND TRADEMARK OFFICE

CERTIFICATE OF CORRECTION

PATENT NO. : 5,725,122

DATED : March 10, 1998

INVENTOR(S) : Joseph B. Murphy et al.

It is certified that error appears in the above-indentified patent and that said Letters Patent is hereby corrected as shown below:

Claim 16, column 6, line 48, insert the word "rim" after the word -- said --; and Claim 19, column 8, line 3, insert the words "as to" after the word -- so --.

Signed and Sealed this

Twenty-eighth Day of March, 2000

*Attest:*

Q. TODD DICKINSON

*Attesting Officer*

*Commissioner of Patents and Trademarks*